United States Patent [19]

Layton et al.

[11] 4,383,235

[45] May 10, 1983

[54] BI LEVEL ETCHED MAGNETIC COIL

[76] Inventors: Wilbur T. Layton, 15210 Sequoia Ct., San Diego, Calif. 92129; Clyde L. Zachry, 13422 Tobiasson Rd., Poway, Calif. 92064

[21] Appl. No.: 61,819

[22] Filed: Jul. 30, 1979

[51] Int. Cl.[3] ..... H01F 27/28

[52] U.S. Cl. ..... 336/200; 336/223

[58] Field of Search ..... 336/223, 200, 221, 222, 336/225, 227, 228

[56] References Cited

U.S. PATENT DOCUMENTS 3,267,402 8/1966 Reimer ..... 336/200

FOREIGN PATENT DOCUMENTS 31075 9/1964 German Democratic Rep. ..... 336/200

447377 3/1968 Switzerland ..... 336/200

*Primary Examiner*—Thomas J. Kozma

[57] ABSTRACT

A bi level electrical inductance coil wherein flat, thin conductors are formed and supported on both sides of a flexible dielectric substrate such that the center line of the conductors on one side overlays the space between the conductors on the other side and such that both ends of each conductor are formed so as to be interdigitated; the ends on one side of the substrate interdigitated with the ends on the other side of the substrate; the substrate and conductors bent so that the conductor ends contact adjacent conductor ends to form continuous turns thus forming a relatively thin flat coil with overlapping conductors to provide a uniform magnetic field particularly useful in bubble memories.

6 Claims, 15 Drawing Figures

28
48
40
34A
26A
42
50
18
22A
38
36
24A
46
32A
44
20
26A
54
34B
26B
22B
52
32B
24B
58
2
4
8
6
22A
34B
26B
18
38
52
24A
46
56
7
5
1
3
24B
28

FIG. 6
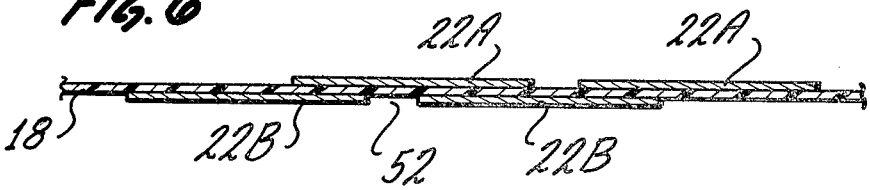
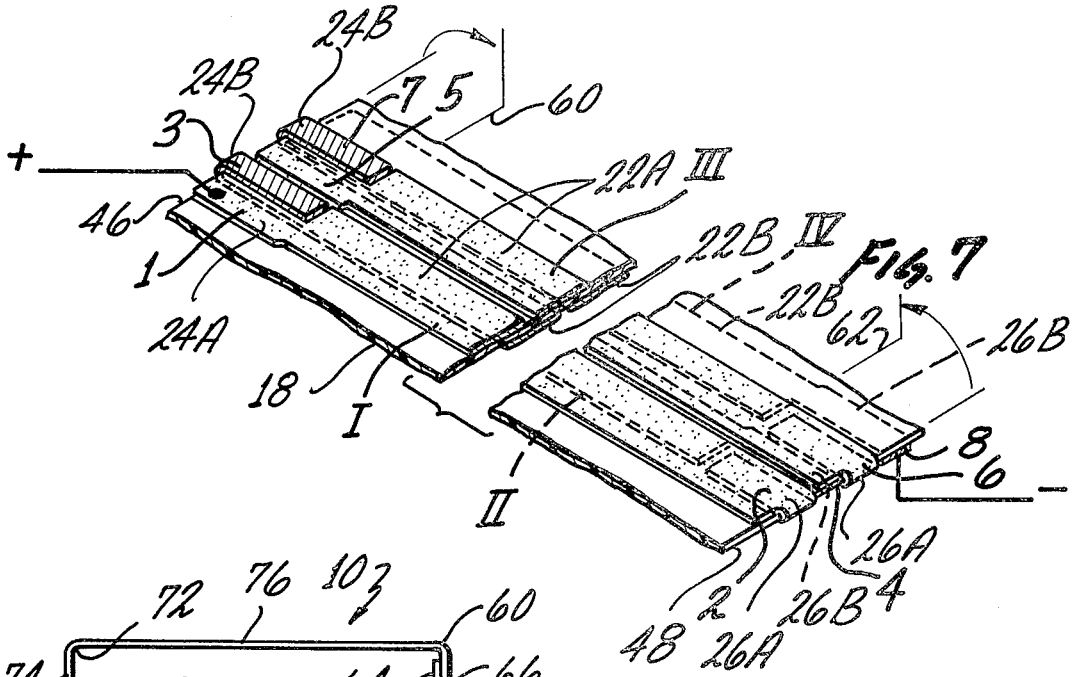
FIG. 7
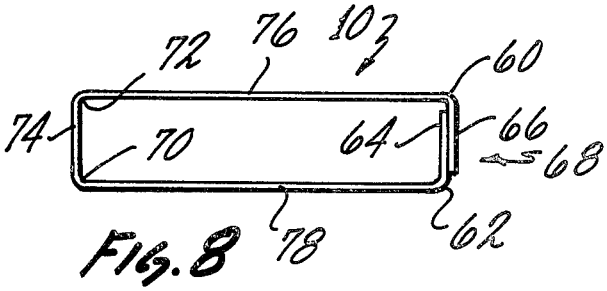
FIG. 8
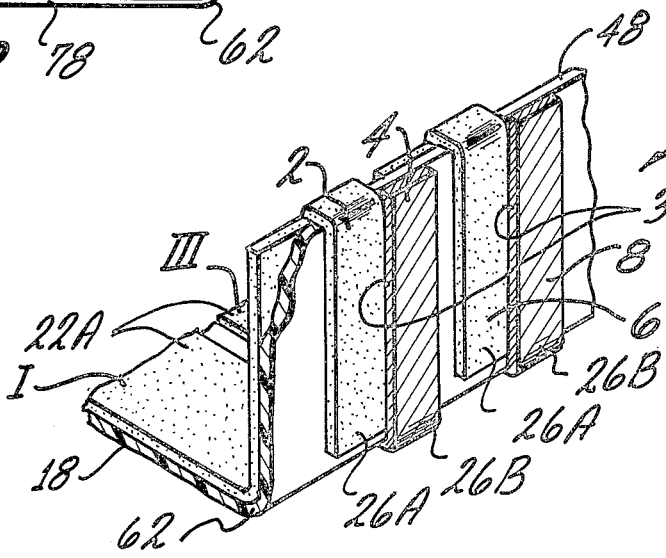
FIG. 9

FIG. 10
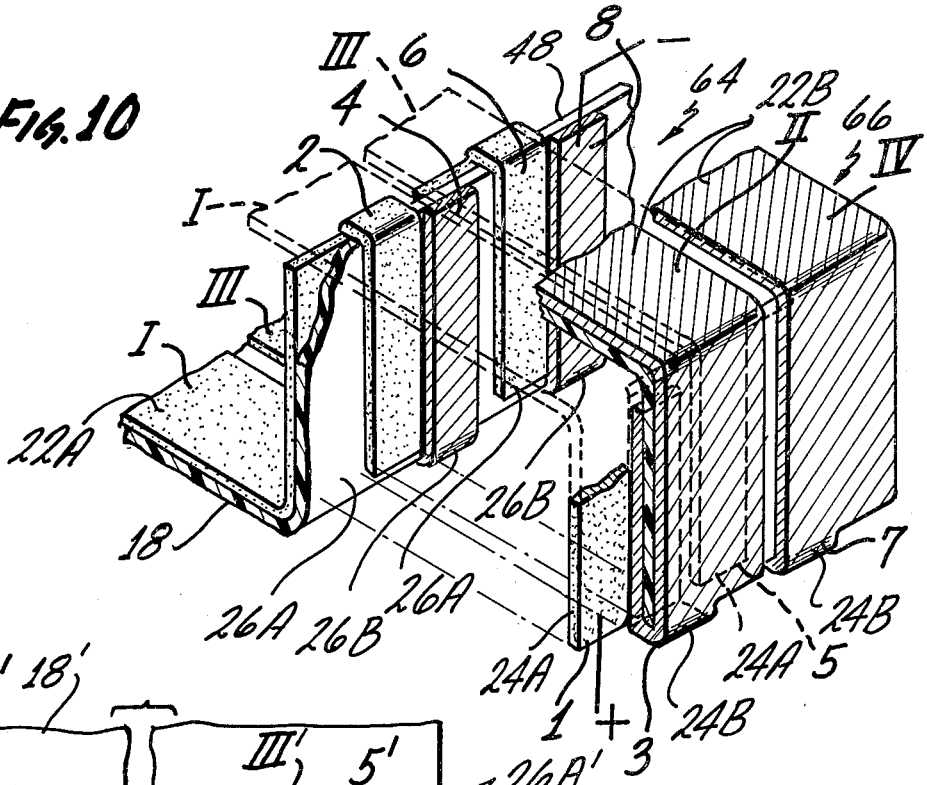
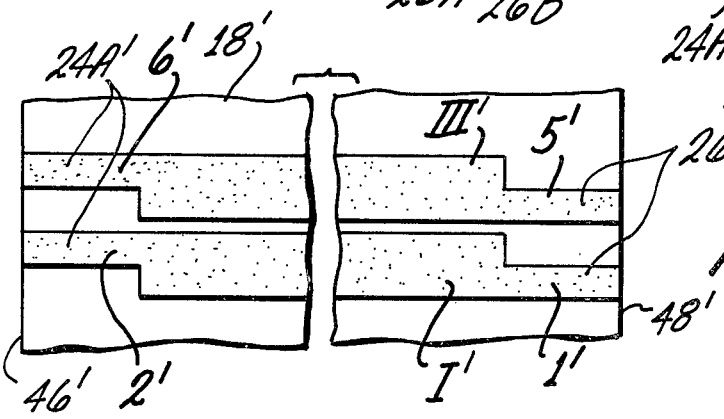
FIG. 11
FIG. 12
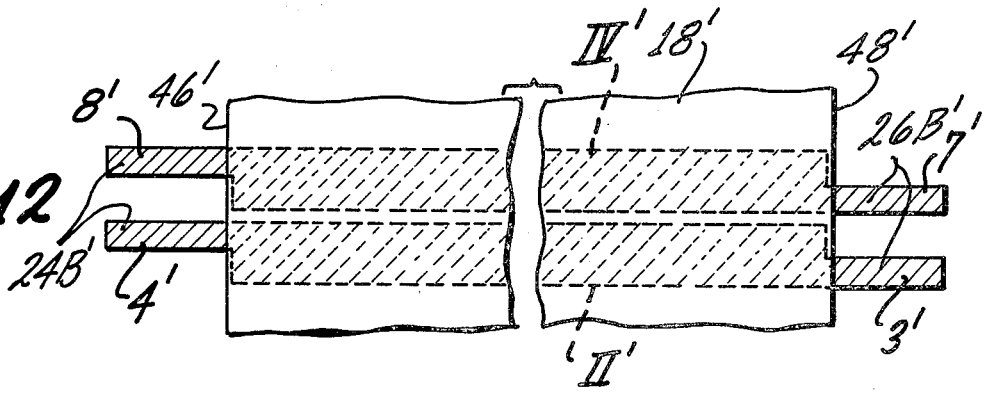

BI LEVEL ETCHED MAGNETIC COIL

RELATED APPLICATIONS

Application for U.S. Patent Ser. No. 955,091, filed Oct. 26, 1978, entitled "Etched Magnetic Coil" by W. T. Layton and Clyde Zachry.

BACKGROUND OF THE INVENTION

This invention relates, in general, to a method of forming electrical inductance coils and the electrical coils formed thereby particularly useful in providing the rotating in-plane magnetic field for the propagation of bubbles in bubble memories.

As stated in the Layton et al Application, supra, there are a number of prior patents relating to the formation of coils of various types and the method and coil disclosed and claimed in the prior Application met the requirements for a coil having a high packing coefficient, at reduced cost with a choice of design of the coil, such as for example, changing the pitch of the coils to vary the induced magnetic field strength and to change the distributed capacitance of the coil.

This invention is directed to further improving the coil disclosed and claimed in the prior Application by improving the uniformity of the field induced by the coil and improving the magnetic efficiency thereof.

It is apparent that, in the coil formed as taught by the prior Application, the spacing of the conductors from one another in the plane of the substrate, induces a non-uniform magnetic field in the center of the coil, i.e., there are valleys and dwells in the magnetic field strength at the center plane of the coil. The present invention, on the other hand, utilizing conductors formed on both sides of the substrate and arranged such that the conductors on one side overlap the spacing between the conductors on the other side, will induce a uniform magnetic field in the plane of the coil when a current flows therethrough. Spacing of coils to provide such a coil utilizing printed circuit board techniques and providing a flat coil having a high packing coefficient at a reduced cost and allowing a choice of design is most difficult to solve but solved by the method taught herein.

Accordingly, it is a primary object of this invention to provide a new and improved method of forming a magnetic coil having improved magnetic characteristics over the prior art coils and to form a coil utilizing printed circuit board techniques.

SUMMARY OF THE INVENTION

The invention which attains the foregoing object comprises a method of forming a bi level electrical inductance coil and the coil formed thereby wherein flat, thin, parallel, spaced-apart conductors are formed and supported on both sides of a flexible dielectric substrate with the center line of the conductors on one side overlying the space between the conductors on the other side; forming tabs on both ends of each conductor so as to be interdigitized; interdigitating the tabs on one side of the substrate with the tabs on the other side of the substrate but out of contact with the conductors of the other side; selectively bending the substrate and conductors so that the conductor tabs contact adjacent conductor tabs to form continuous turns thus forming a relatively thin flat coil with overlapping conductors to provide a uniform magnetic field, particularly useful in bubble memories. In one embodiment, the connecting tabs form one end wall of the coil and in another embodiment the tabs extend outwardly beyond the coil.

BRIEF DESCRIPTION OF THE DRAWINGS

FIG. 6 is a cross-sectional view of FIG. 5 taken along line 6—6 of FIG. 5, FIG. 7 is a perspective view of a portion of the coil showing the tabs bent over the edges of the substrate and the position of the tabs relative to one another, FIG. 8 is a side view illustrating the manner in which the coil is formed with the tabs in contact with one another to form a continuous coil, FIG. 9 is an enlarged perspective view of a portion of FIG. 8 illustrating a bend of one end of the coil as illustrated in the arrow of FIG. 7 to form the coil of FIG. 8, FIG. 10 is an exploded view to illustrate more clearly how the tabs when bent will form one continuous coil as in FIG. 8, FIG. 11 is a plan view of the top of the substrate along the conductor pattern for the second embodiment of the invention, FIG. 12 is a plan view of the top of the substrate showing the conductors on the bottom side of the substrate.

BRIEF DESCRIPTION OF THE PREFERRED EMBODIMENTS

As explained in the foregoing Layton et al Application, one very practical use for the magnetic inductance coil, the product aspect of this invention, is to provide a rotating in-plane magnetic field for a bubble memory and one advantage is that the same printed circuit board techniques may be used as are used in making the flexible circuit boards for such memories.

Figure 13:
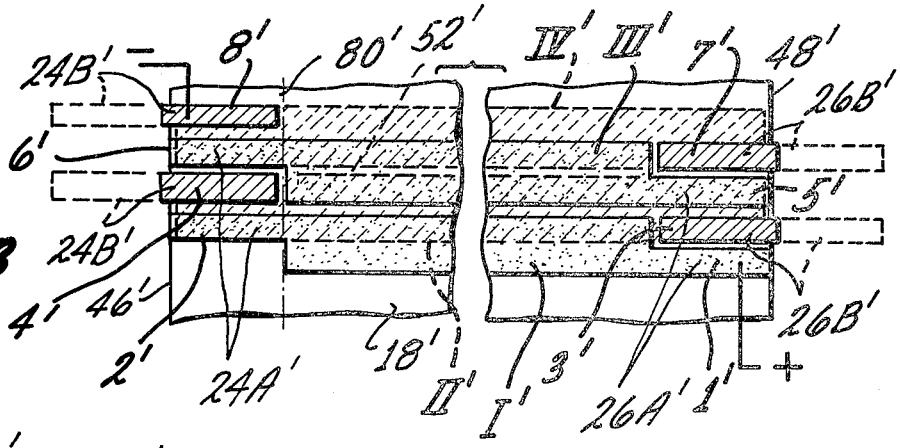
FIG. 13 shows the manner in which the tabs are bent around the edges of the substrate.
Figure 14:
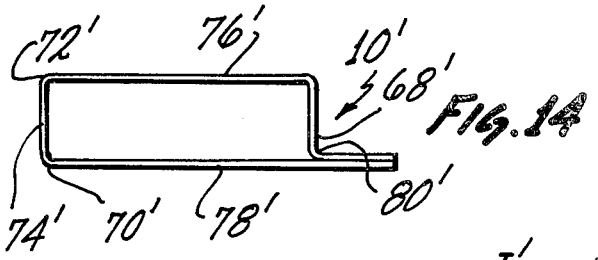
FIG. 14 illustrates a side view of the coil formed according to the second embodiment of the invention.
Figure 15:
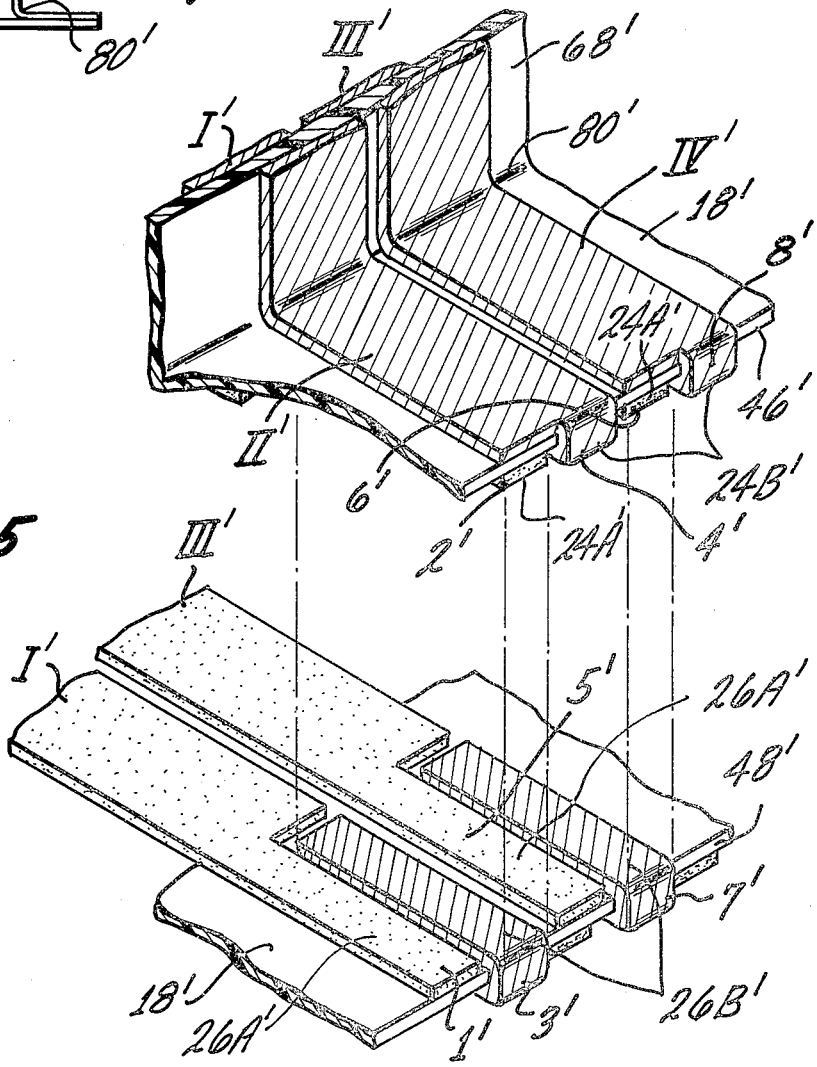
FIG. 15 is an exploded view of a portion of FIG. 14 to show the manner in which the tabs are connected to form a continuous coil.

It should be pointed out at this time that FIGS. 1–10 are directed to one embodiment of the invention wherein a coil product 10 is shown in its final form in cross-section in FIG. 8, while FIGS. 11–15 are directed to a second embodiment of the invention wherein a coil product 10' in its final form is shown in cross-section in FIG. 14.

Figure 1:
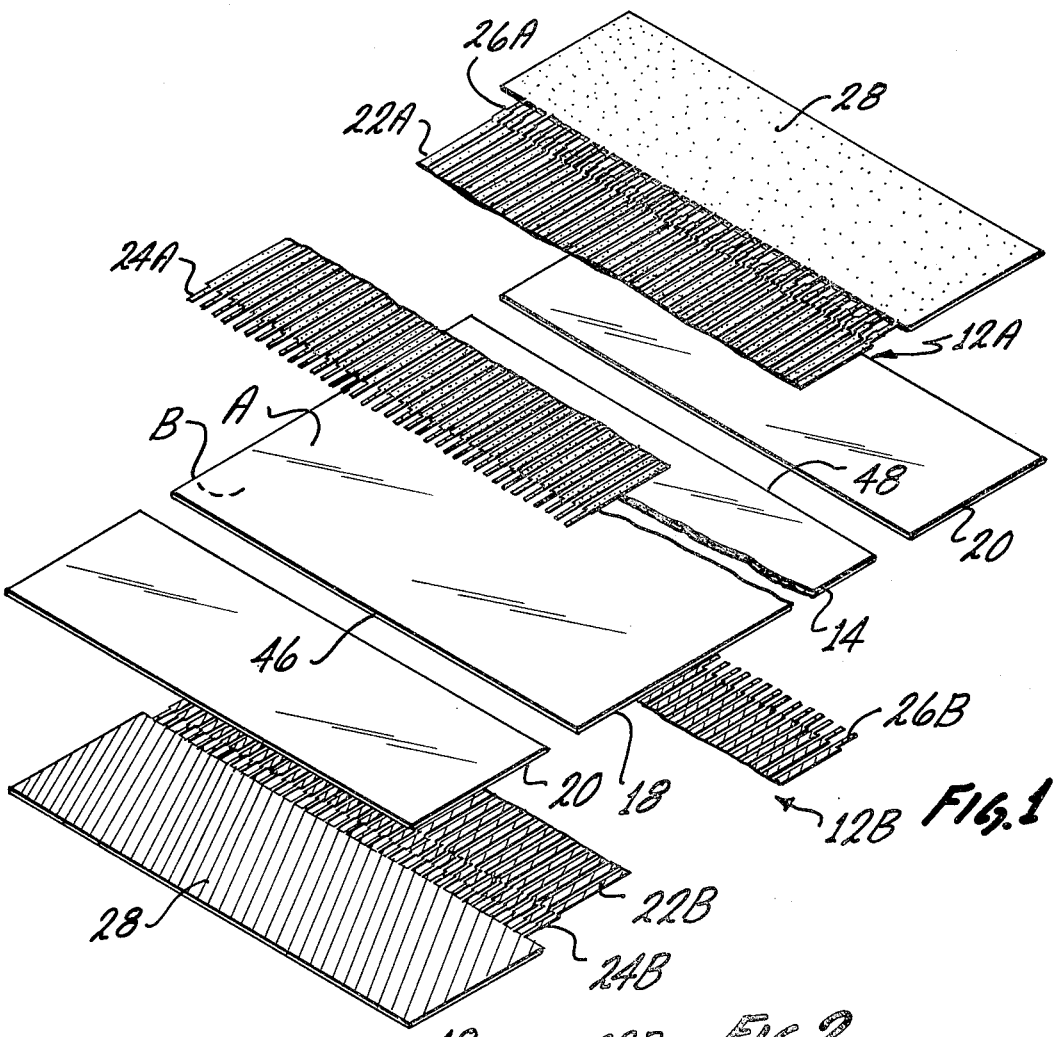
FIG. 1 is an exploded view to illustrate clearly the conductors on both sides of the dielectric substrate.
Figure 2:
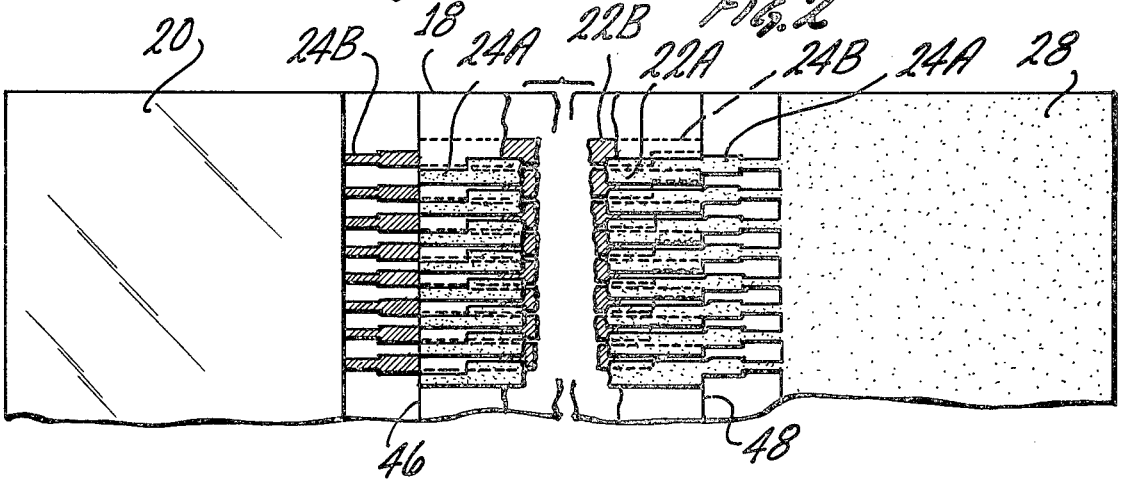
FIG. 2 is a plan view of a portion of the coil showing the conductors on both sides of the substrate and their position relative to one another.

Turning now to FIG. 1, the first step in the formation of the electrical inductance coil 10 as shown in FIG. 8 is to form patterns comprising a flat, parallel, spaced-apart, copper strip conductors 12A and 12B on both sides, A and B, of a flexible dielectric substrate 14, such as Kapton, to provide a coil blank or workpiece.

The conductors 12A and 12B can be pre-etched separately and later laminated to the flexible dielectric substrate 14, or they can be etched on a substrate which is copper coated on both sides; the latter is shown in FIG. 1 although the view is exploded to clarify disclosure of the invention. This figure also shows a separation between the main portion 18 of the substrate 14 and two end pieces 20. This is simply to show a support for the main portions 22A and 22B of the conductors by the center or main portion 18 of the substrate 14 and, as will be clear, for support of some of the tabs identified in groups as 24A, 24B, 26A and 26B and for support of the tie bars 28 which are used in the formation of the conductors and which are later cut off, or otherwise removed.

The cross-section of each of these copper strip conductors 12A and 12B is substantially rectangular whose area is selected according to the current to be carried therethrough. The term "substantially rectangular" is selected because of the fact that the cross-section of these conductors differs slightly from true rectangularity due to the consequences of etching.

The number of conductors and their length depends upon the width of the coil and the size of the core, or other subassembly such as one or more bubble memory chips, to be enclosed by the coil. As best shown in FIGS. 2–5 and as stated above, on side A of the substrate 14 the ends of the conductors 12A are formed with tabs 24A and 26A extending in opposite directions. These tabs are about half of the width of the main portions 22A of the conductors and are formed by removing, as by etching, rectangular portions 32A and 34A from the main portion 22A in such a manner that each of the tabs 24A has only one edge 36 substantially in line with edge 38 of the main body portion 22A and each of the tabs 26A have only one edge 40 substantially in line with edge 42 of the main body portion 22A. The area of each of rectangular portions 32A and 32B is slightly larger than the area of the tabs 24A and 26B to accommodate the latter in the formation of the coil as will be clear in the description hereinafter. Whether the conductors are formed separately and laminated to the substrate 14, or etched on the substrate 14, the width of the main portion 18 of the substrate 14 is determined by the length of the main conductor portion 22A plus the length of the tabs 24A so that the outer edges 44 of the tabs 24A are coextensive with the outer edge 46 of the substrate while the tabs 26A extend beyond the outer edge 48 of the substrate; the latter being coextensive with the edge of the main portion of the conductor as at 50. Edges 46 and 48 of the substrate correspond to the edges of the main portion 18 of the substrate as shown in FIG. 1.

Figures 3, 4, 5:
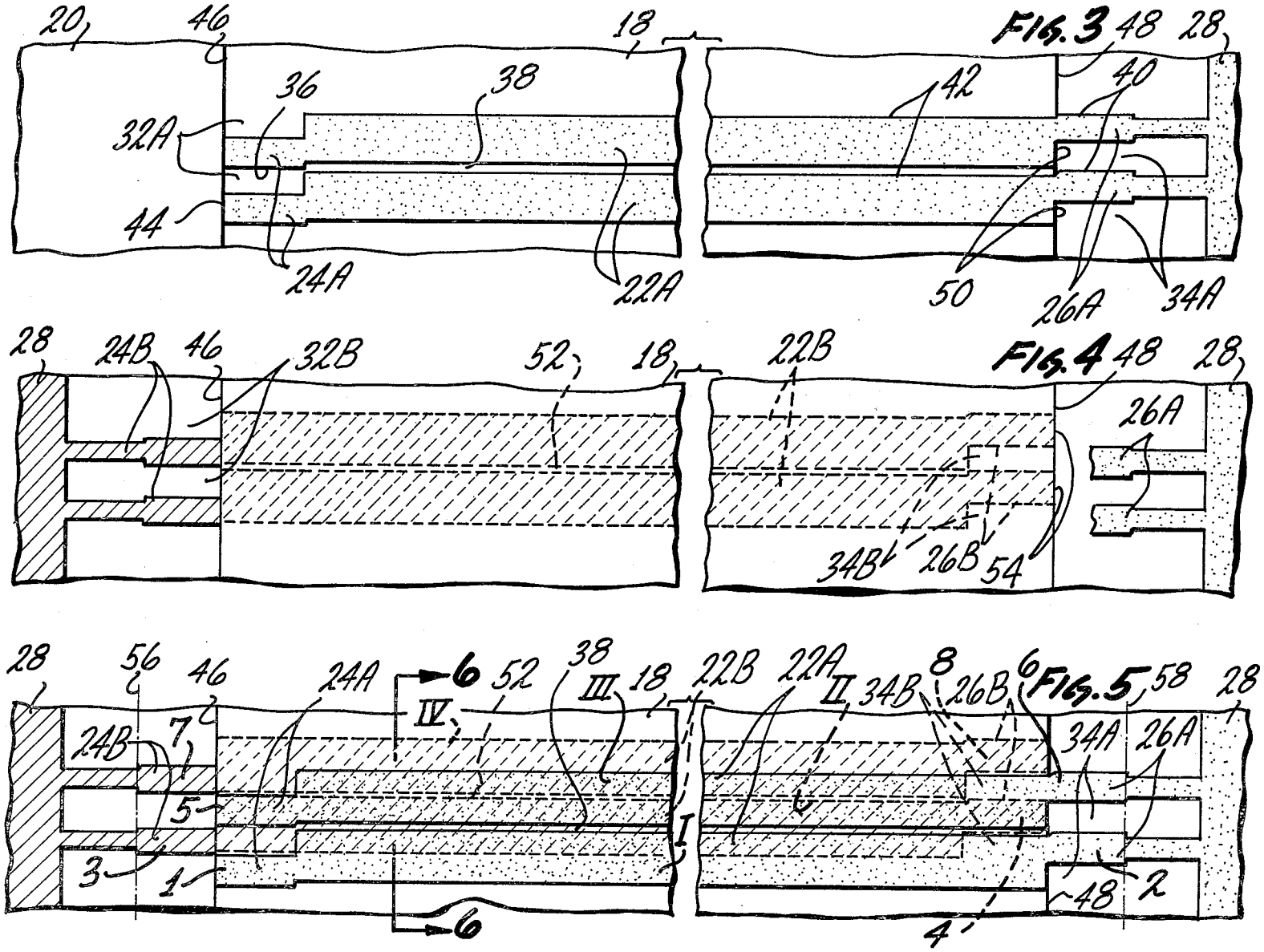
FIG. 3 is a plan view illustrating two conductors on the top side of the substrate.
FIG. 4 is a plan view of the top side of the substrate showing the conductor on the bottom side of the substrate.
FIG. 5 is a plan view of the conductors from both sides of the substrate and illustrating their position relative to one another.

On the opposite side of the substrate, side B, as in FIG. 4, the pattern of conductors 12B is somewhat similar to the pattern on side A of the substrate, except that the spacing 52 between the main portions 22B of the conductors is located substantially on the center line of the main portions 22A of the conductors of side 12A. This is more clearly shown in FIG. 2 and in FIG. 6 and provides the means for providing a continuous magnetic field when the coil is in use. The main portions 22B of the conductors 12B terminate on the edge 46 of the substrate 20 with the tabs 24B extending beyond this substrate edge. This differs from the pattern on side A where the tabs 24A terminate on this edge of the substrate, the ends 54 of the tabs 26B terminate coextensive with the substrate edge 48, which again is different from tabs 26A on side A. Again, note that the tabs 24B and 26B alternate with respect to the edges of the conductors although different from that of the tabs on conductors on side A and that areas 32B and 34B are provided on the substrate next to their respective tabs.

Again, if the pattern of conductors 12B is made apart from the substrate, the main body portion of the conductors are laminated to the substrate with the tabs 24B extending beyond the edge 46 while tabs 26B are placed so that their ends 54 are coextensive with the edge 48 of the substrate. On the other hand, if the conductors are formed by etching from a sheet of double faced copper substrate, the substrate is later removed to form the tabs.

The next step is best viewed in FIG. 5 where the ends of the tabs are actually cut as at 56 and 58 from the tie bars 28 formed on the circuit board during the circuit board manufacturing process.

The next step in the process is best viewed in FIG. 7 where the tabs 24B and 26A which extend beyond the edges 46 and 48 of the substrate are bent over and around the edges of the substrate and interdigitized, respectively, with the tabs 24A and 26B on the opposite side of the substrate. Note that the function of the rectangular areas 32A, B and 34A, B now become clear in that they permit the tabs to overlie and engage the opposite side of the substrate yet are not electrically connected in anyway with the remainder of the conductors at this point in the process.

The next step is the beginning of the formation of the coil where the conductors and substrate are bent transversely at bend lines or zones 60 and 62 as shown in FIG. 7 to the position shown in FIG. 9, to form a pair of coil ends 64 and 66 which together form one end wall 68 as illustrated in FIG. 8. The position of the lines or zones 60 and 62 from the edges 46 and 48 of the substrate depends upon spacing required for the core or subassembly to be encompassed by the coil. This also determines the length of the tabs since the bend lines or zones 60 and 62 are selected at the ends of the tabs which are bent over the edges of the substrate.

After the two ends 64 and 66 are formed, the substrate and conductors are again bent at two bend lines or zones 70 and 72 so as to form a second end wall 74 and two side walls 76 and 78, both of which are generally parallel with one another. The spacing between the end walls 68 and 74 and between the side walls 76 and 78 is determined by the thickness or spacing of the coil in which the core or subassembly is to be enclosed.

The terms bend "line" and "zone" are used since the bend itself may not be a well defined sharp line but may have a radius of curvature. Thus, the walls may not be a plane but slightly curved end walls. This definition also applies to all subsequently referred to "walls" and bend "lines" and "zones".

As can be seen in FIGS. 8, 9 and 10, the tabs on the end 64 and 66 which form the end wall 68 are in engagement with one another and are welded or suitably soldered together. This can be done by flow soldering but any other suitable means may be used.

Now in order to understand how the conductors are placed in electrical continuity by the tabs, attention is now directed to FIGS. 3–5, 7, 9 and 10 where certain individual tabs forming part of the group of tabs 24A and 24B and 26A and 26B are renumbered. This will give a specific example of the electrical continuity through three or four of the conductors forming one continuous coil which are connected to a suitable source of current (+) to (−) or ground.

Therefore, starting with tab 1 of tabs 24A as shown in FIGS. 3, 4 and 5, the connection of tab 1 with a source of current (+) will cause current to flow through main conductor portion I to tab 2. Tab 2 is shown bent underneath the substrate in FIG. 7 and shown facing outwardly in FIGS. 9 and 10. Tab 2 engages tab 3, as shown in FIG. 10, which is bent upwardly and over the top surface of the substrate in FIG. 7. The compound bend between FIGS. 7 and 10 places this tab 3 facing tab 2 as in FIG. 10. Current from tab 2 flows to tab 3 and through the conductor II to tab 4 which is shown beneath the substrate in FIGS. 4, 5 and 7. Tab 4 is part of the group of tabs 26B and is shown in an upright position adjacent tab 2 in FIGS. 9 and 10 facing and engaging tab 5 shown in FIG. 5 as part of the group of tabs 24A therein. Current flows from tab 4 and through conductor III from tab 5 to tab 6 formed in conductor III. Tab 6 engages tab 7 on conductor IV which carries current to tab 8 which is connected in this example to a negative voltage source (−) or to ground as shown in FIGS. 9 and 10. Thus, current will flow from conductor I to conductor VI by reason of the engagement of the tabs in the overlying wall structure 64 and 66. Obviously this example is simply to show configuration current flow which will continue on as far as there are conductors and tabs in the coil.

The second embodiment is disclosed in FIGS. 11–15 with the coil 10 being formed, as shown in cross-section, in FIG. 14. In this embodiment the printed circuit manufacturing techniques is the same as described in connection with the first embodiment. And where possible to simplify and shorten the description of the second embodiment, the same references will be used except a prime ′ is added.

In this embodiment, the conductors 22A′ formed on one side of the substrate A′ are considerably shorter than the conductors 22B′ formed on the other side, side B′, of the substrate 14′. Thus, on side A′ of the substrate, the width of the substrate corresponds to the main body portion 22A plus the length of both tabs 24A′ and 26A′ on each side of the main body portion so that the very ends of the tabs are coextensive with the edges 46′ and 48′ of the substrate. On the other hand, the conductors formed on side B′ of the substrate are such that the main body portion 22B′ is coextensive with the width of the substrate while the tabs 24B′ and 26B′ on each end of the conductors extend outwardly from the substrate. Again, like the conductors in the first embodiment, the center line such as 52′ of the conductors on one side of the substrate overlie the space between the conductors on the second side of the substrate and the tabs are arranged so that they can be bent around the edges 46 and 48 of the substrate and be interdigitized. This is shown in FIG. 13 where the dotted portion shows the tabs 24B′ and 26B′ in their original position and the solid line portion shows the tabs bent around the edges of the substrate so as to be adjacent the tabs 24A′ and 26B′ on the conductors on the side A of the substrate.

After the tabs 24B′ and 26B′ are bent in the manner shown in FIG. 13, the conductors and the substrate are bent preferably first along a bend line or zone 70′ and then secondly around a bend line or zone 72′ to establish an end wall 74′ and a first side wall 78′. The length of the side wall and the end wall are determined by the size of the core or subassembly to be enclosed by the coil. A third bend line or zone is made as at 60′ at a position determined by the length of the first side wall 78′ and the wall 76′ formed by this bend is positioned parallel to the first side wall. Finally, the substrate and conductors are bent in the opposite direction to the other bends as at 80 forming end wall 68′ and so that the tabs overlie one another and engage to form one continuous coil. Again, like the first embodiment, the tabs are connected as by flow soldering or welding.

In order to understand how the embodiment forms a continuous coil, the conductor and tabs are numbered. Thus, with the tabs connected to a suitable current source (+) and reference source (−) or ground, current will flow from tab 1′ through conductor I′ to tab 2′. Tab 2′ engages tab 3′ bent around the substrate from side B′ so current flows from tab 2′ to tab 3′ and through conductor II of side B′ to tab 4′. Tab 4′ engages tab 5′ for current to flow from conductor II to conductor III and on to tab 6′. Tab 6′ engages tab 7′ bent around the substrate from side B′ to allow current to flow through conductor IV to tab 8′, the latter being connected to negative voltage (−) or ground.

Finally, from the foregoing, it can be seen that relatively thin walled coils are formed in a unique manner. The conductors overlie one another to provide a uniform coil in the plane of the magnetic inductance field. The size and spacing of the conductor lines can be varied to control the magnetic field formed by the coils and the distributed capacitance of the coils at the time the conductor lines are formed. Note, too, the coil, being originally a flat workpiece, can be formed around a core or subassembly.

What is claimed is:

1. An inductance coil comprising:

a plurality of relatively flat, thin, spaced-apart conductors rectangular in cross-section disposed in parallel relationship on both sides of a flexible dielectric substrate, said conductors on one side of said substrate overlying the space between the conductors on the other side of the said substrate, the ends of said conductors being narrower than the center of said conductors to form tabs, said tabs being interdigitized at each end of said flexible substrate, said flexible substrate being bent to connect said interdigitized tabs and form one continuous coil.

2. The inductance coil as claimed in claim 1 wherein said bent substrate forms a pair of end walls and a pair of side walls, with one of said side walls also being formed by said tabs in overlapping and connected relationship with one another.

3. The inductance coil as claimed in claim 1 wherein said bent substrate forms a pair of end walls and a pair of side walls and wherein said tabs are disposed parallel to one of said side walls.

4. The inductance coil as claimed in claim 1 wherein said bent substrate forms a pair of end walls and a pair of side walls, with said connected interdigitized tabs extending therefrom.

5. The inductance coil as claimed in claim 1 wherein said tabs are flow soldered to each other to form one continuous coil.

6. The inductance coil as claimed in claim 1 wherein said tabs are welded to each other to form a continuous coil.

* * * * *

UNITED STATES PATENT AND TRADEMARK OFFICE

CERTIFICATE OF CORRECTION

PATENT NO. : 4,383,235

DATED : May 10, 1983

INVENTOR(S) : Wilbur T. Layton et al.

It is certified that error appears in the above-identified patent and that said Letters Patent is hereby corrected as shown below:

On the title page insert:

-- /73/ Assignee: Burroughs Corporation,

Detroit, Mich. --.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*